US006179350B1

(12) United States Patent
Ely et al.

(10) Patent No.: US 6,179,350 B1
(45) Date of Patent: Jan. 30, 2001

(54) DRAW LATCH

(75) Inventors: Keith A. Ely, Kennet Square; James J. Ford, West Chester, both of PA (US); H. Allen Riblett, Ardentown, DE (US); Lynn B. Ziemer, Glen Mills, PA (US)

(73) Assignee: Southco, Inc., Concordville, PA (US)

( * ) Notice: Under 35 U.S.C. 154(b), the term of this patent shall be extended for 0 days.

(21) Appl. No.: 09/235,631

(22) Filed: Jan. 22, 1999

(51) Int. Cl.[7] ..... E05C 5/00; E05C 19/12

(52) U.S. Cl. ..... 292/113; 292/285; 292/DIG. 49

(58) Field of Search ..... 292/113, 281, 292/285, 205, 209, 286, 211, 282, DIG. 49, 247; 70/2, 13

(56) References Cited

U.S. PATENT DOCUMENTS

| | | | | |
|---|---|---|---|---|
| D. 230,132 | | 1/1974 | Pastva, Jr. | D8/109 |
| D. 367,218 | | 2/1996 | Ford et al. | D8/331 |
| D. 371,953 | | 7/1996 | Ford et al. | D8/331 |
| D. 371,954 | | 7/1996 | Ford et al. | D8/331 |
| D. 374,806 | | 10/1996 | Ford et al. | D8/331 |
| D. 377,141 | | 1/1997 | Ford et al. | D8/331 |
| D. 377,446 | | 1/1997 | Ford et al. | D8/331 |
| 575,493 | * | 1/1897 | Richmond | 292/286 |
| 2,301,116 | * | 11/1942 | Gusbeth | 292/286 |
| 2,987,908 | | 6/1961 | Pelcin | 70/146 |
| 3,145,038 | | 8/1964 | Swanson | 292/113 |
| 3,174,784 | | 3/1965 | Swanson | 292/113 |
| 3,519,298 | * | 7/1970 | Gley et al. | 292/113 |
| 3,534,992 | | 10/1970 | Swanson | 292/113 |
| 3,936,082 | | 2/1976 | Swanson | 292/113 |
| 3,954,293 | | 5/1976 | Orr | 292/256.5 |
| 4,049,301 | | 9/1977 | Schenk | 292/113 |
| 4,053,177 | | 10/1977 | Stammreich et al. | 292/113 |
| 4,181,333 | * | 1/1980 | Stelma | 292/66 |
| 4,307,906 | | 12/1981 | Schenk | 292/247 |
| 4,352,513 | | 10/1982 | Gunther | 292/113 |
| 4,600,396 | * | 7/1986 | Crane et al. | 292/247 |
| 4,705,308 | * | 11/1987 | Bisbing | 292/108 |
| 4,793,163 | * | 12/1988 | MacFarlane et al. | 70/2 |
| 4,890,869 | | 1/1990 | Langkamp, Jr. | 292/113 |
| 5,125,697 | * | 6/1992 | Kahl et al. | 292/204 |
| 5,131,246 | * | 7/1992 | Bonzer | 70/260 |
| 5,165,148 | | 11/1992 | Fleischer et al. | 24/494 |
| 5,271,649 | | 12/1993 | Gromotka | 292/113 |
| 5,438,853 | * | 8/1995 | Bartsch | 70/69 |
| 5,462,318 | * | 10/1995 | Cooke | 292/200 |
| 5,478,125 | | 12/1995 | Gromotka | 292/67 |
| 5,669,638 | | 9/1997 | Anderson et al. | 292/111 |
| 5,732,987 | * | 3/1998 | Wright et al. | 292/113 |

* cited by examiner

*Primary Examiner*—Lynne H. Browne
*Assistant Examiner*—John B. Walsh
(74) *Attorney, Agent, or Firm*—Paul & Paul

(57) ABSTRACT

A draw latch for attaching one member to another, such as a first panel to a second panel, is unlatched and latched by lifting the latch handle in one direction or the other about a pivot axis, which actuates a pawl member which is pivoted to engage and secure a first catch of a keeper, the handle being pivoted to be secured on a second catch of a keeper, with the pawl being latched against a spring bias provided by a keeper member. The handle is securable by a lock which locks the handle to the second catch to prevent release of the pawl from engagement with the first catch.

33 Claims, 6 Drawing Sheets

133
135
137
129
126
136
131
124
132
134
123
150
152
151
125
117
18
122
111
116
119
121
118
158
14
18
157
156

DRAW LATCH

BACKGROUND OF THE INVENTION

1. Field of the Invention

This invention relates to the field of latches, and more particularly to a draw latch.

2. Brief Description of the Prior Art

A variety of draw latches are known for providing a latching action which is achieved by drawing a clamping member against, or over, another member. Generally, a keeper member is mounted to one panel surface and a clamping member of the latch, which is mounted on a second panel surface, engages the keeper and draws the panels together when the clamping member is drawn toward or over the latch body. Draw latches essentially are comprised of a handle assembly and a keeper. The handle assembly generally includes the components of the base, a lever and a catch, with the base and lever being pivotally connected to each other, and with the catch and lever being pivotally connected to each other. In operation, the handle assembly is adapted to be mounted onto a first panel member and the keeper is adapted to be mounted on a second panel member and is designed to receive the catch for latching. Generally, when the catch engages the keeper, a downward force is applied to the lever which causes the catch to pull the panels together and into a fastened position. In essence, the latching action is achieved by rotating the lever about a pivot axis.

In the art of over-center draw latches, it is known to provide a draw latch having a base member a lever and a catch. The base and lever are pivotally connected to each other with the catch and lever being pivotally connected to each other. The pivotal connections are generally at the locations of the shafts. Prior art latches of this type, although effective for securing one or more members or panels together, have an undesirable effect of freely movable members. In order to enable the components of this type of latch to be retained in open positions, a technique used includes applying a plastic resistance member between the pivot shaft pivotally connecting the lever and base, and the pivot shaft that connects the lever and the catch. This plastic member provides a sufficient frictional resistance between these pivot shafts, that it will maintain the basic three components in various positions, relative to each other. However, such a plastic member comprises essentially a fourth component which can increase cost and the work associated with assembly of the latch. Generally, the additional plastic member has been replaced, and dimples or detents used to provide a resistance to keep the members of the latch assembly in a variety of given positions. For example, an over-center draw latch having a base and lever pivotally connected to each other, with a catch being pivotally connected to the lever is shown in U.S. Pat. No. 4,890,869 "Over-Center Draw Latch", the complete disclosure of which is herein incorporated by reference.

In the operation of draw latches, the handle assembly is adapted to be mounted onto a first panel member and the keeper is adapted to be mounted on a second panel member. The keeper is further designed to receive the catch for latching. When the catch engages the keeper, a downward force is applied to the lever which causes the catch to pull the panels together into a fastened position. In such a latch, the latching action is achieved by rotating the lever to shift the pivotal connection of the catch and the lever in relation to a line extending between the keeper and the point of pivotal connection of the lever and base. Generally, there are two distinct latching actions for such latches, namely, over-center and under-center. An over-center action provides the pivot connection of the lever and the catch below the centerline between the base and the keeper when in the fastened position. With respect to an under-center action, the pivot of the lever and the catch is positioned above the centerline of the base and the keeper when fastened. For unlatching, an upward force is applied to the lever in order to provide rotation of the lever in the direction opposite that for latching. A disadvantage with conventional draw latches however is that following rotation of the lever for unlatching; the catch must manually be raised in order to be disengaged from the keeper. In one type of draw latch known, a spring which automatically raises or provides "kick-out" of the catch from the keeper when unlatched is utilized. However, in this type of draw latch, the catch movement generally cannot be controlled. For example, when unlatched, the spring operates to force the catch from the keeper in all instances, even in those situations where it is desirable to have the catch remain in other positions. An example of a draw latch which addresses and overcomes such drawbacks is disclosed in U.S. Pat. No. 5,478,125, "Draw Latch With Catch Having Kick-Out Action" wherein controlled kick-out action of the latching member is featured, the complete disclosure of which is herein incorporated by reference.

Another example of a draw latch assembly includes a base and a handle and an underlying pawl. The handle is rotated to secure the latch in a latching position by moving the underlying pawl member therewith. In this type of latch assembly, the handle does not itself secure to a keeper. The latching is accomplished by the pawl securing to a keeper member.

Other prior known draw latches are provided for use in panels wherein a gasketing member is provided on the panel to supply a biasing force.

A need exists for a latch which can provide the benefits of a draw latch with improved locking and securing capabilities.

SUMMARY OF THE INVENTION

The present invention provides a novel over-center draw latch which can be used to secure a first member to a second member, such as, for example, a panel closure member to an enclosure, or two panels to each other. A locking member enables one or more of the latch elements to be locked to prevent opening of the latch assembly. A primary clamping member and a secondary clamping member are provided. The primary clamping member is pivotally connected to a base member and the secondary clamping member is pivotally connected to the primary clamping member. The primary clamping member or handle is rotatable relative to the base, and partially relative to the secondary clamping member or pawl for a portion of its rotational arc, and rotatable with the secondary clamping member or pawl for another portion of its rotational arc. Engaging means is provided to facilitate the cooperative rotation of the primary and secondary clamping members throughout at least a part of the arc through which the primary clamping member moves. Primary and secondary catches are provided on the keeper member to engage and secure, respectively, the pawl and the handle.

It is an object of the present invention to provide a novel latch assembly where a handle actuates a pawl member for engagement with a keeper member and wherein the handle is separately securable to a keeper member.

Another object of the present invention is to provide a latch with an alignment feature which aligns two panels which are to be secured with the latch.

It is another object of the present invention to provide alignment elements which align the panels relative to each other and/or one or more of the latch components.

It is a further object of the present invention to accomplish the above objects by providing a handle member which is pivotally movable with a pawl for a portion of the handle member pivot and relative to the pawl for another portion of the handle member pivot.

A further object of the present invention is to provide a novel latch which can be locked with a separately provided locking member.

It is another object of the present invention to provide an interference between the handle and pawl members to provide rotation of the handle and pawl together over a portion of the handle's pivot arc.

It is another object of the present invention to provide biasing means which facilitate latching and retention of the panels secured with the latch.

Another object of the present invention is to accomplish the above objects where the latch is configured to minimize injury to a user that might otherwise occur from inadvertent contact with one or more of the latch components.

BRIEF DESCRIPTION OF THE DRAWING FIGURES

DETAILED DESCRIPTION OF THE PREFERRED EMBODIMENTS

Figure 1:
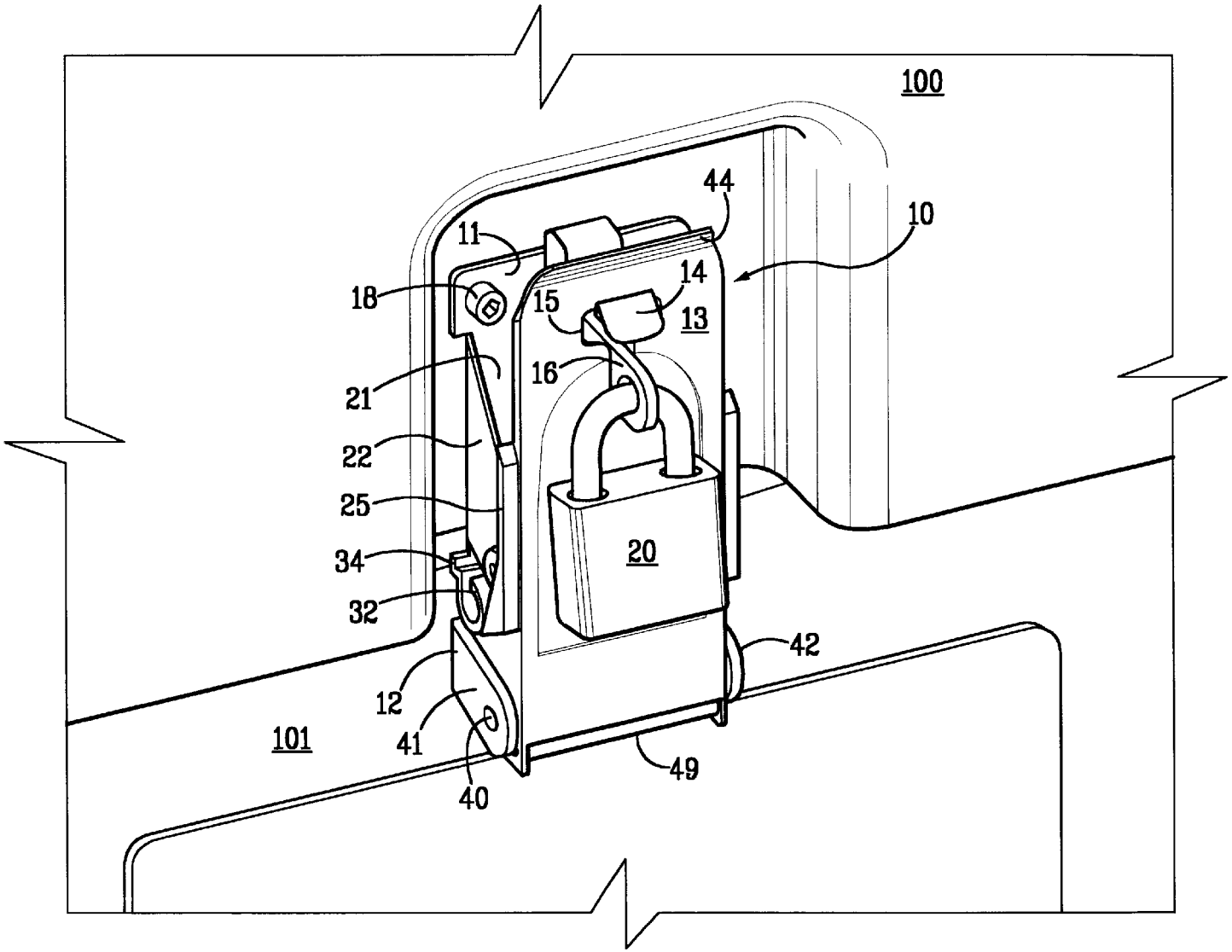
FIG. 1 is a front perspective view, viewed from the left side, of a latch assembly according to the present invention shown in an installation securing two panel members together.
Figure 4:
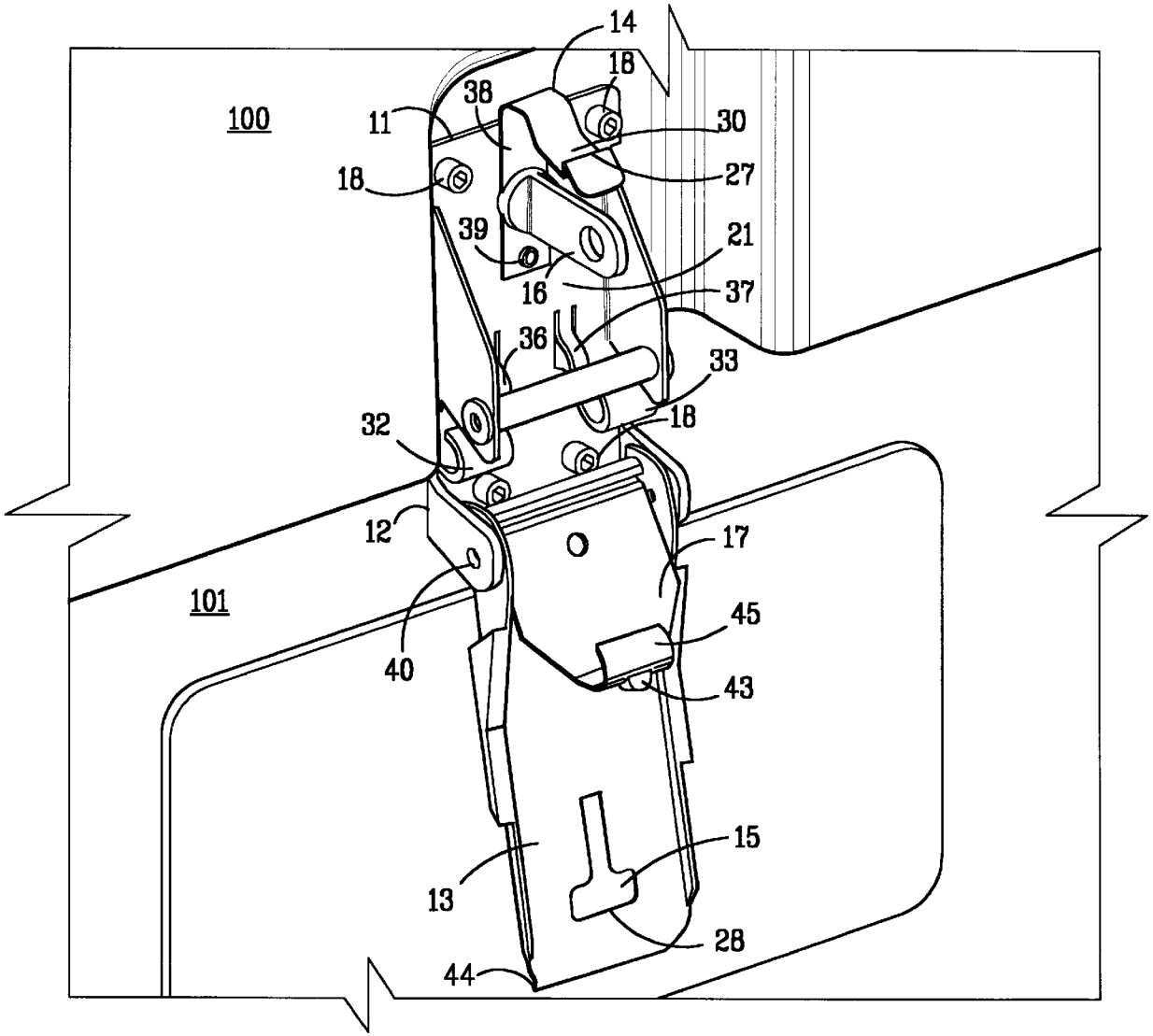
FIG. 4 is a left side perspective view of the latch assembly of FIG. 1 shown in a fully opened unlatched position.

Referring to FIG. 1, a preferred embodiment of a latch assembly 10 according to the present invention is shown mounted in an installation securing together two members, such as the upper panel 100 and lower panel 101. The latch assembly includes a keeper member 11 shown mounted to the upper panel 100, and a base member 12 shown mounted on the lower panel 101. The base member 12, as shown in FIG. 4, can be mounted to the lower panel 101 with suitable securing means such as bolts 18. Actuation means, such as the latch handle 13, is shown pivotally mounted to the base member 12. The base member 12 carries the handle 13 which is shown secured to the keeper 11 with a secondary catch member 14. The handle 13 is provided with securing means, comprising the slot 15 disposed therein. Preferably, the slot 15 comprises a t-shaped configuration to align with and receive the secondary catch 14 therein. While not shown, the secondary catch 14 can be provided as an integral member with the keeper 11 for operation as described herein. The keeper member 11 further includes hasp means shown comprising an outwardly extending flange portion 16 having an aperture therein for receiving locking means. While the locking means is shown in FIG. 1 comprising a padlock 20, it will be understood that any suitable locking means, such as, for example, a pin, bar, cord, chain, or the like can be used as well, depending on the application and level of security required.

Figure 2:
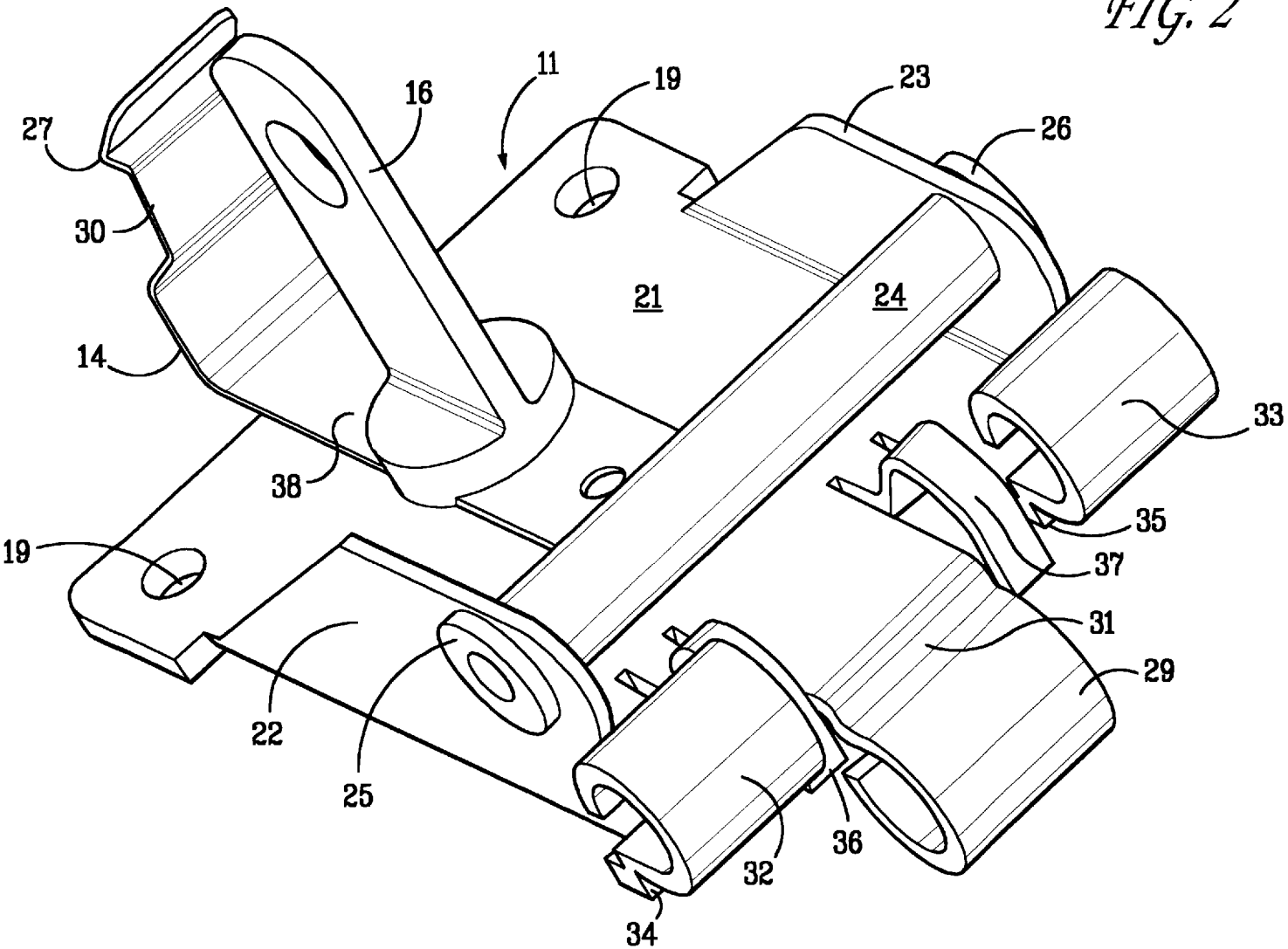
FIG. 2 is a left side perspective view of the front of the keeper member viewed from the bottom left looking toward the top right of the keeper.

Referring to FIG. 2, the keeper member 11 is provided having a mounting portion 21 with a pair of upwardly protruding flange members 22,23. Mounting means is provided for mounting the keeper 11 to a mounting surface, such as the upper panel 100 (FIG. 1). The mounting means is shown comprising a plurality of apertures in the mounting portion 21 of the keeper member 11 by which the keeper member 11 is secured with securing means, such as the bolts 18 (FIG. 1). The keeper member 11 includes a primary catch 24 for securing a pawl member. The primary catch 24 is shown comprising a pin extending transversely between the upwardly extending flange portions 22,23 and secured at either end thereof with securing means, such as, for example, the end fittings 25,26. Alternately, other suitable means for securing the pin 24 to the keeper 11 can be utilized, including compression of the pin ends, washers, nuts, or the like.

Figure 3:
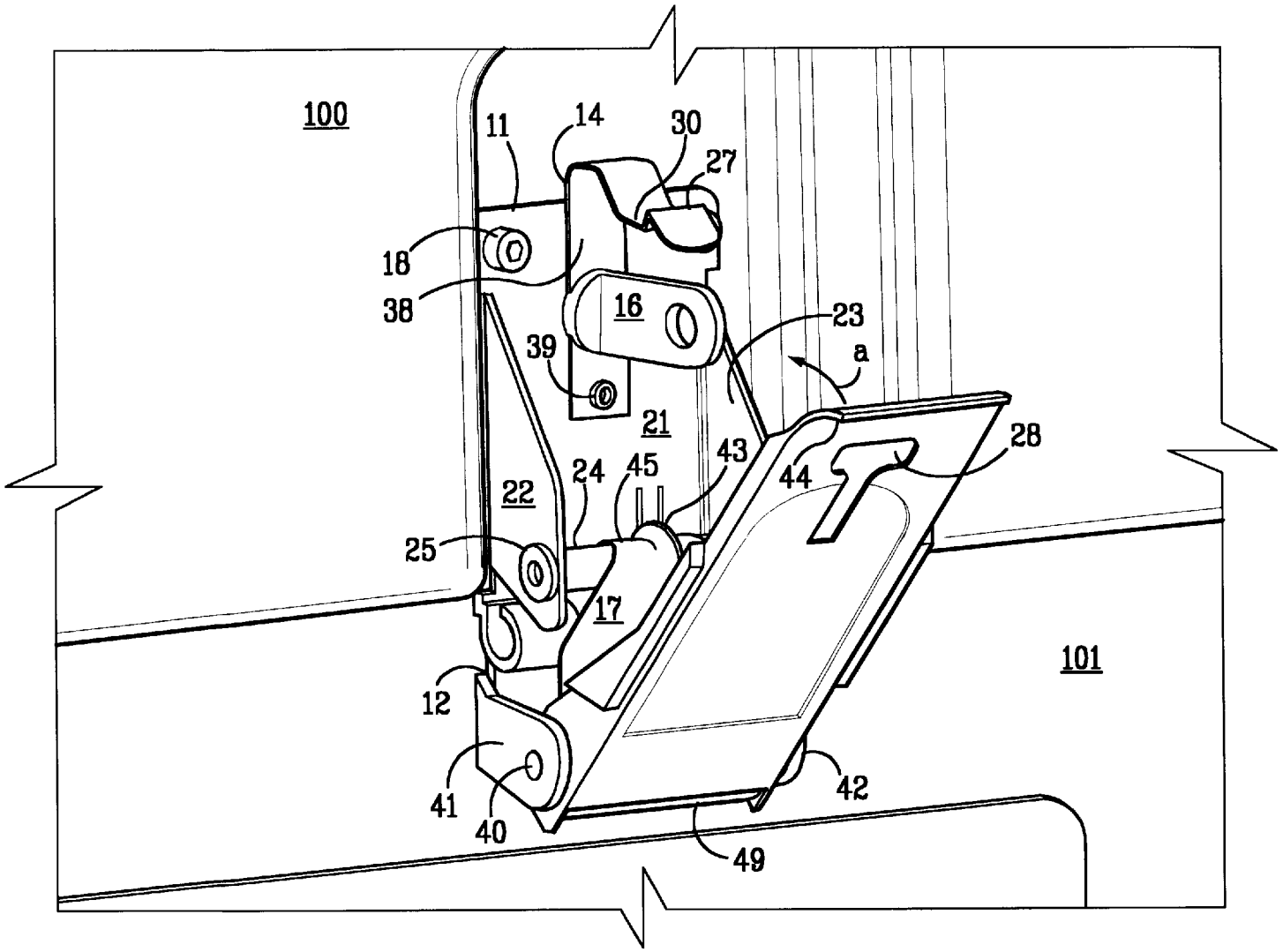
FIG. 3 is a left side perspective view of the latch assembly of FIG. 1 shown with the primary and secondary catch members disengaged from the keeper through a partial arc of rotation.

Closure means is provided on the keeper member 11 for securing the pawl 17 and handle 13 and maintaining the latch assembly 10 in a latched condition. The keeper member 11 is shown comprising a secondary catch 14 which extends outwardly from the top of the keeper member 11, as shown in FIG. 2. The secondary catch 14 preferably is provided as a flexible, spring member which has an engaging lip 27 for engaging the handle 13 at the engaging edge 28 of the handle slot 15 and urging the edge 28 of the handle 13 onto the retaining shelf 30 of the secondary catch 14. Preferably, as shown in FIG. 2, the engaging lip 27 is sloped and, while not shown, is deflected downwardly relative to the top of the keeper 11 when the force of the handle 13 is encountered through engagement with the engaging edge 28. The engaging lip 27 is further provided with a flange portion for facilitating gripping thereof by a user when the secondary catch 14 is to be depressed for release of the handle 13. When latched, as shown in FIG. 1, the secondary catch 14 remains slightly stressed by the handle 13 to provide a resistance which facilitates maintenance of the handle 13 in the latched position. The secondary catch 14 is provided having a mounting portion 38 which is mounted to the keeper member mounting portion 21. As shown in FIGS. 3 and 4, the secondary catch 14 can be mounted to the keeper 11 by a rivet 39. Other suitable mounting means, such as, for example, bolts, welds, and the like may also be employed.

The keeper member 11 is also provided with aligning means for aligning the upper and lower panels 100, 101, respectively, together to ensure proper meeting of the latch components, namely, the alignment of the base member 12 and components carried thereby with the upper panel 100 and keeper member 11 mounted thereon. The central aligning tab 29 extends downwardly from the mounting portion 21 of the keeper member 11 and includes a stepped portion forming an aligning ridge 31. Preferably, the lower panel 101 can engage the aligning ridge 31 when the latch assembly 10 is brought together for fastening. In addition, aligning tabs 32,33 are provided on each end of the keeper member 11, on opposite lateral sides of the central aligning tab 29. Preferably, the lateral aligning tabs 32,33 each have a stepped portion forming an aligning ridge, respectively, 34,35 for facilitating alignment of the assembly 10 by engaging the lower panel 101 as the latch 10 is secured. The aligning tabs 29,32,33 are shown in a preferred radial configuration in order to avoid the potential danger of rough edges which could otherwise be encountered by a user through inadvertent contact when the latch 10 is installed on a panel.

Resistance means is provided on the keeper member 11 to maintain a tight connection of the latch components when the assembly 10 is secured. The resistance means is shown comprising a pair of spring members 36,37 extending from the bottom of the keeper member mounting portion 21. The spring members 36,37 distribute a constant force to the assembly as the pawl member 17 is drawn to engage the pawl pin 24 and secure the pawl 17 thereto.

Figure 5:
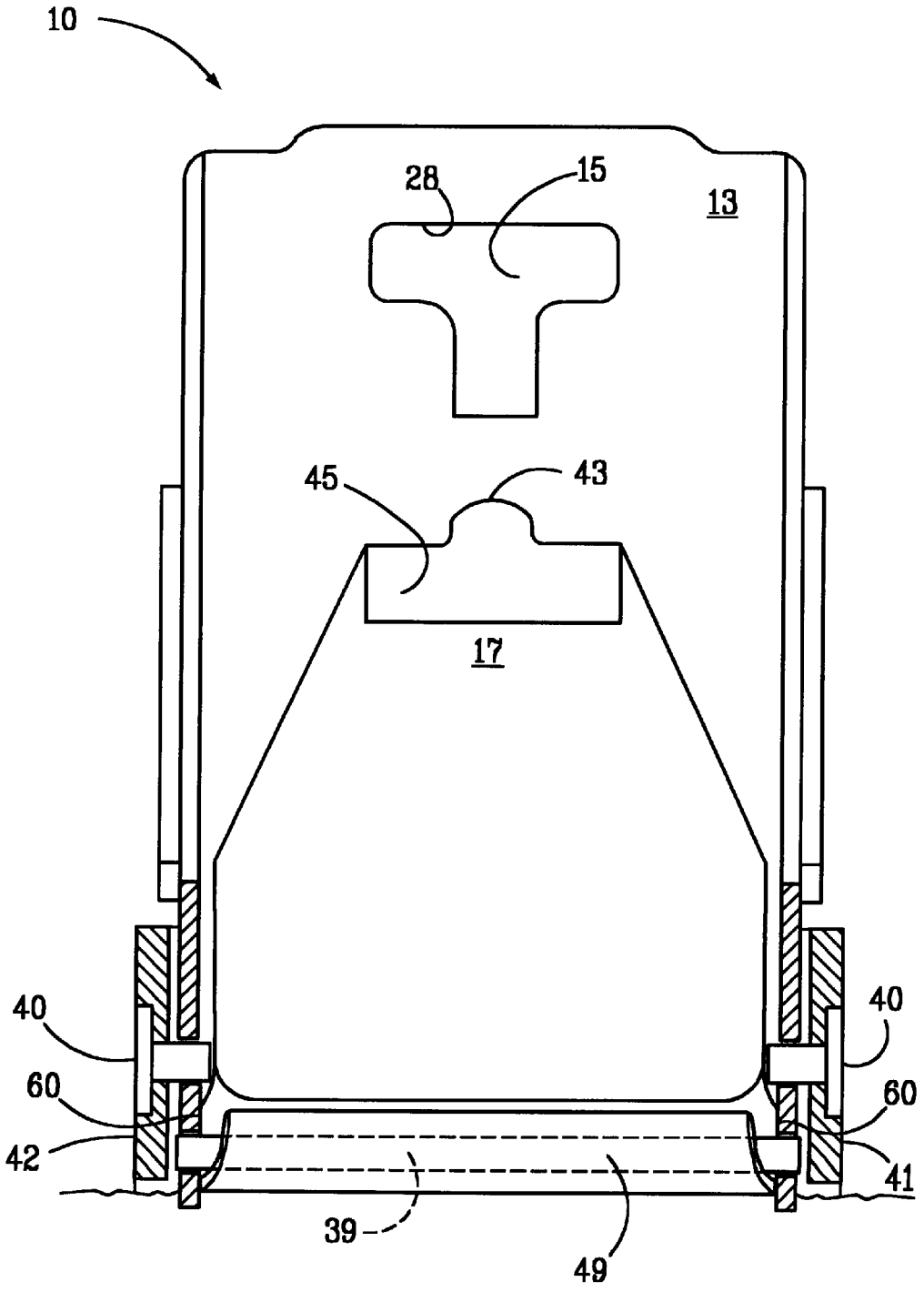
FIG. 5 is a rear elevation view of the handle and pawl shown attached to a base member where the handle and base member are shown in partial sectional view.

FIGS. 4 and 5 show the handle 13 secured to the base member 12 for rotational movement thereabout. A pair of mounting pins 40 secure the handle 13 to the base member 12. The base member 12 is shown having a pair of outwardly extending flange portions 41,42 defining opposite sides of the rotational axis about which the handle 13 and pawl 17 pivot. The pawl 17 is pivotally attached to the handle 13 with suitable mounting means, such as, for example, the pivot member 39. As alternatives to the pair of mounting pins 40, bearings, tabs or other like suitable pivot fasteners can be used to secure the handle 13 to the base 12. Similarly, the pawl mounting means can also comprise a pair of mounting pins, bearings or other suitable fasteners.

Referring to FIG. 5, the pawl 17 and handle 13 pivot assembly is shown. The pawl 17 includes a radial lower portion with which the pawl 17 is pivotally mounted with the mounting pin 39 extending through the lower radial portion 49. The pawl 17 is provided to move with the handle 13 during a portion of the pivot movement of the handle 13. The handle 13 is also able to pivot over a portion of its pivot arc independent of the pawl 17.

As shown in FIGS. 3 and 4, the latch 10 appears in two conditions. FIG. 3 shows the pawl 17 engages with the pawl pin 24. The pawl 17 is shown having a radially configured terminal portion 45 which engages the pawl pin 24. As the handle 13 is moved from its FIG. 3 position to a latching (FIG. 1) position in the direction indicated by arrow "a", the pawl 17 draws the keeper 11 and panel 100 attached thereto toward the base member 12. A strengthening rib 43 is provided on the terminal radial portion 45 of the pawl member 17 to fortify the pawl 17, in particular, during latching and when the latch 10 is secured.

The handle 13 preferably is provided with a gripping means, such as the gripping flange 44 for facilitating lifting of the handle 13 into and out of its engaged position. The handle 13 is shown in its disengaged, relaxed position in FIG. 4. When the handle 13 is raised by lifting from its FIG. 4 position toward the position shown in FIG. 1, the handle 13 pivots toward the keeper 11 over an arc about the pivot axis provided by the pivot member 40. During a first portion f the pivot, the handle 13 pivots relative to the base 12. The pawl 17 is lifted and secured on the pawl pin 24. The lifting of the handle 13 toward engagement with the secondary catch 14 forces the pawl 17 downward to securely engage the pawl pin 24. The spring members 36,37 of the keeper 11 provide a bias which acts upon the pawl 17 as it is pivoted from its FIG. 4 position to its latched position, and continues upon latching of the pawl 17 with the pawl pin or catch 24.

An interference means 60 can preferably be provided between the pawl 17 and the handle 13. For example, the pawl 17 can be provided with a protruding configuration, such as a raised boss, or can be provided with an enlarged width as shown in FIGS. to create friction between the handle 13 as the handle 13 is pivoted. The interference means permits the latch 10 to be unlatched with the pawl 17 remaining in a partially pivoted position, such as that shown in FIG. 3. As shown in FIG. 4, the latch 10 is in its fully opened position with the handle 13 close to 180 degrees relative to its latched position of FIG. 1. The pawl 17 in FIG. 4 is shown open less than 180 degrees. The interference means operates to maintain the pawl 17 at the partially pivoted position relative to the handle 13.

Figure 6:
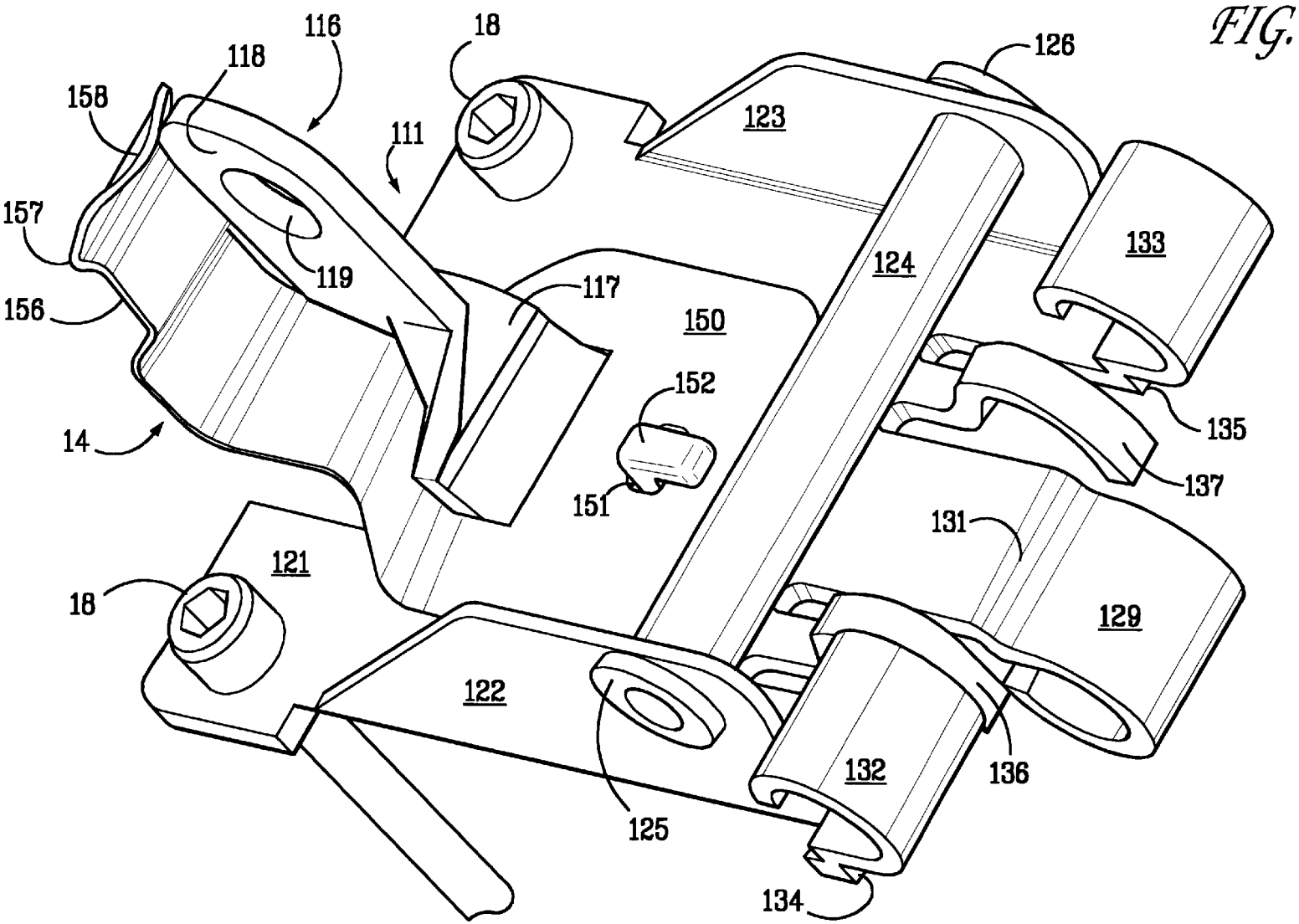
FIG. 6 is a left side perspective view of the front of an alternate keeper member embodiment viewed from the bottom left looking toward the top right of the keeper.

Reference now being made to FIG. 6, wherein an alternate embodiment of a keeper member 111 according to the present invention is shown. The keeper 111 is provided to be used with the handle 13 and base 12 elements described above. Bolt members 18 can, as described above, be used to mount the keeper 111 onto a mounting surface, such as the upper panel 100 described and shown above. The keeper 111 is shown having a hasp means including a flange 116 protruding outwardly therefrom. The flange 116 has a twisted configuration with the lower portion 117 thereof being perpendicular to the upper or outermost portion 118. An aperture 119 is provided in the outer portion 118 of the flange 116 for receiving a locking member, such as the padlock 20 shown in FIG. 1. The keeper member 111 has a mounting portion 121 with flanges 122, 123 on each side thereof. A catch is provided comprising a pin 124 which is retained on the keeper 111 at the flanges 122,123 with attachment means. The attachment means are shown in FIG. 6 comprising retaining members 125, 126 which hold the pin 124 in place. As described in connection with the keeper 11 in FIGS. 1–4, the alignment means comprising the alignment tabs, 129, 132 and 133 are utilized in the alternate keeper 111 embodiment. Alignment ridges 131,134, and 135 are also provided to facilitate positioning of the panels, such as those 100 and 101, which are secured by the latch. Spring members 136, 137 are also provided. The secondary catch 114 is shown having a mounting portion 150. The mounting portion 150 has a slot 151 therein. The keeper 111 is provided with catch mounting means comprising a mounting finger 152. The mounting finger 152 extends from the mounting portion 121 of the keeper 111 and protrudes through the slot 150 of the catch 114. The mounting portion 150 of the catch 114 extends into a radial arm 159 which includes a shelf portion 156 and a lip 157. As described above, a tab 158 is shown for facilitating the operation of the secondary catch 114 by a user who depresses the arm 159 of the catch 114 to release a handle, such as the handle 13 of FIGS. 1, 3 and 4, from engagement therewith.

These and other advantages of the present invention can be made consistent with the spirit and scope of the invention as disclosed in the Summary of the Invention, the Brief Description of the Drawing Figures, the Detailed Description of the Preferred Embodiments and the appended claims.

What is claimed is:

1. A latch assembly for securing two panels together, said latch assembly comprising:

a) a keeper member adapted for mounting on a first panel;

b) closure means adapted for mounting on a second panel, said closure means having a pawl and a handle, and including means for supporting said pawl and said handle for rotational movement from an unlatched position to a latched position wherein said handle and said pawl engage said keeper member;

c) wherein said keeper member includes a primary catch for engagement with the pawl, and a secondary catch for engagement with the handle;

d) wherein said keeper member has a mounting portion with a pair of flange members extending upwardly therefrom; and e) wherein said primary catch comprises a pin extending transversely between said upwardly extending flange portions, and wherein said pin has a first end secured to one of said flange portions and a second end secured to the other of said flange portions.

2. The latch assembly of claim 1, wherein the handle includes a slot therein, and wherein said keeper member has hasp means extending therefrom for facilitating locking of the latch with locking means, said handle being movable to engage said keeper and be secured thereby, with said hasp means extending through said slot.

3. The latch assembly of claim 2, wherein said hasp means includes an aperture therein for receipt of the locking means therein, said aperture being formed near one end of said hasp means thereby defining an aperture end of said hasp means.

4. The latch assembly of claim 3, wherein said secondary catch comprises a spring member.

5. The latch of claim 4, wherein said secondary catch includes a shelf portion and a ridge portion.

6. The latch assembly of claim 1, wherein said handle includes a slot therein and said secondary catch further includes a gripping portion for facilitating the depression of said secondary catch relative to said handle to release said secondary catch from engagement with said handle slot.

7. The latch assembly of claim 3, wherein said hasp means has a twisted portion at its end opposite the aperture end, and wherein the secondary catch is provided with a slot therein for accommodating the hasp means, said secondary catch being installed over the hasp means for retention on the keeper member.

8. The latch assembly of claim 7, wherein the keeper member further comprises a retaining member for retaining the secondary catch thereon.

9. A latch assembly for securing two panels together, said latch assembly comprising:

a) a keeper member adapted for mounting on a first panel;

b) closure means adapted for mounting on a second panel, said closure means having a pawl and a handle, and including means for rotating said pawl and said handle from an unlatched position to a latched position wherein said handle and said pawl engage said keeper member; and c) wherein said keeper member includes a primary catch for engagement with the pawl, and a secondary catch for engagement with the handle;

d) wherein the handle includes a slot therein, and wherein said keeper member has hasp means for facilitating locking of the latch assembly with locking means extending therefrom, said handle being movable to engage said keeper member and be secured thereby, with said hasp means extending through said slot; and e) wherein said hasp means includes an aperture therein for receipt of locking means therein, wherein said secondary catch comprises a spring member.

10. The latch assembly of claim 9, wherein said pawl has a radial engaging portion for engaging said keeper member, and wherein the pawl includes a strengthening portion provided on the radial engaging portion thereof.

11. The latch of claim 9, wherein said keeper member further comprises biasing means for biasing the closure means in relation to the keeper member for facilitating securing of the pawl and handle to the keeper member.

12. The latch of claim 11, wherein said biasing means comprises at least one tab portion extending from said keeper member.

13. The latch of claim 9, further comprising alignment means for aligning the position of a panel to be secured by said latch assembly.

14. The latch of claim 13, wherein said alignment means comprises a ledge portion extending from said keeper member.

15. The latch of claim 14, wherein said ledge portion includes safety means for facilitating inadvertent contact by a user with the latch assembly.

16. The latch of claim 15, wherein said safety means comprises a radial edge portion provided on the lower portion of the keeper member.

17. The latch assembly of claim 9, wherein said locking means comprises a padlock.

18. The latch assembly of claim 9, wherein said handle rotates through an arc of rotation, said pawl rotates through an arc of rotation having a radius and said arc of rotation of said handle has a larger radius relative to the radius of the arc of rotation of the pawl.

19. The latch assembly of claim 18, further comprising interference means to provide frictional resistance between the handle and the pawl.

20. A latch assembly for securing two panels together, said latch assembly comprising:

a) a keeper member adapted for mounting on a first panel, said keeper member having a mounting portion and a pair of flanges extending outwardly from said mounting portion;

b) a base member adapted for mounting on said second panel; closure means being pivotally carried on said base member and having a handle member and a pawl member, said handle member and said pawl member each having a rotational axis for movement toward and away from said keeper member, for selectively latching and unlatching the latch assembly, said handle member having a slot therein;

d) a first catch provided on the keeper member for securing said pawl member thereto;

e) a second catch provided on the keeper member for securing said handle member thereto;

f) wherein said first catch comprises a transverse pin having one end which is mounted to one of said keeper member pair of flanges and another end which is mounted to another of said keeper member pair of flanges;

g) wherein said pawl member has a radial engaging portion for securing the pawl member to said transverse pin; and h) wherein said second catch comprises a spring member mounted to said keeper member and including a portion extending outwardly from said keeper member, said second catch having on the outwardly extending portion a shelf for engaging the handle slot, wherein said second catch is depressed by said handle member for clamping of the handle member to the keeper member and wherein said second catch is depressed to release the handle member from the clamping force of the second catch.

21. The latch assembly of claim 20, wherein the pawl member includes a strengthening portion provided on the radial engaging portion thereof.

22. The latch assembly of claim 20, further including interference means between the handle member and the pawl member.

23. The latch assembly of claim 22, wherein said handle member rotates through an arc of rotation and said interference means facilitates movement of the pawl member with the handle member throughout a portion of the arc of rotation of said handle member during the operation of the latch assembly.

24. A latch assembly for securing two panels together, said latch assembly comprising:

a) a keeper member adapted for mounting on a first panel, said keeper member having a mounting portion and a pair of flanges extending outwardly from said mounting portion;

b) a base member adapted for mounting on said second panel;

c) closure means for securing the keeper member relative to said base member and maintaining the latch assembly in a latched position, said closure means including a handle member and a pawl member, said handle member being pivotally mounted to said base member and said pawl member being pivotally mounted to said handle member, wherein said handle member is pivotally movable toward and away from said keeper member and wherein said pawl member is translatably and pivotally movable toward and away from the keeper member for selectively latching and unlatching the latch assembly, and wherein said handle member has a slot therein;

d) a first catch provided on the keeper member for securing said pawl member thereto;

e) a second catch provided on the keeper member for securing said handle member thereto;

f) wherein said first catch comprises a transverse pin having one end which is mounted to one of said keeper member pair of flanges and another end which is mounted to the other of said keeper member pair of flanges;

g) wherein said pawl member has a radial engaging portion for securing the pawl member to said transverse pin and a strengthening portion provided on the radial engaging portion thereof;

h) wherein said second catch comprises a spring member mounted to said keeper member and including a portion extending outwardly from said keeper member, said second catch having on the outwardly extending portion a shelf for engaging a first portion of said handle slot, wherein said second catch is depressed by said handle member for clamping of the handle member to the keeper member and wherein said second catch is depressed to release the handle member from the clamping force of the second catch; and wherein said keeper member has hasp means extending therefrom for facilitating locking of the latch with locking means, said handle member being movable to engage said spring member and be secured thereby, with said hasp means extending through a second portion of said handle slot;

i) wherein said hasp means includes an aperture therein for receipt of locking means therein;

j) said handle member rotating through an arc of rotation during the operation of the latch assembly interference means for providing frictional resistance between the handle member and the pawl member for facilitating movement of the pawl member with the handle member, together, throughout a portion of the arc of rotation of said handle member during the operation of the latch assembly;

k) biasing means for biasing the closure means in relation to the keeper member for facilitating securing of the pawl member and handle member to the keeper member; and l) alignment means for aligning the position of the first panel relative to the second panel, said alignment means comprising a ledge portion extending from said keeper member.

25. A latch assembly for securing two panels together, said latch assembly comprising:

a) keeper member adapted for mounting on a first panel;

b) closure means adapted for mounting on a second panel, said closure means having actuating means for selectively operating the latch assembly, and pawl means for securing the closure means to the keeper member; wherein the actuating means comprises means for moving the pawl means into and out of engagement with the keeper member for respectively latching and unlatching the latch assembly;

c) wherein said keeper member comprises first means for securing the pawl means thereto and second means for securing the actuating means thereto, said actuating means comprising lock means to selectively lock said pawl means into a latched position;

d) wherein said keeper member has a mounting portion with a pair of flange members extending upwardly therefrom; and d) wherein said first means for securing the pawl means thereto comprises a pin extending transversely between said upwardly extending flange portions, and wherein said pin has a first end secured to one of said flange portions and a second end secured to the other of said flange portions.

26. The latch assembly of claim 25, further comprising resistance means provided on said keeper member for imparting a resistive force between the keeper member and the closure means when the keeper member and the closure means are brought together for securing.

27. The latch assembly of claim 25, wherein the means for moving the pawl means into and out of engagement with the keeper member for respectively latching and unlatching the latch assembly comprises a handle, having a handle slot and wherein said second catch further includes a gripping portion for facilitating the depression of said second catch relative to said handle to release said second catch from engagement with said handle slot.

28. A latch assembly for securing two panels together, said latch assembly comprising:

a) a keeper member adapted for mounting on a first panel;

b) closure means adapted for mounting on a second panel, said closure means having a pawl and a handle, and including means for rotating said pawl and said handle from an unlatched position to a latched position wherein said handle and said pawl engage said keeper member;

c) wherein said keeper member includes a primary catch for engagement with the pawl, and a secondary catch for engagement with the handle; and d) wherein said handle rotates through an arc of rotation having a larger radius relative to the radius of the arc of rotation of the pawl; and interference means to provide frictional resistance between the handle and the pawl.

29. The latch assembly of claim 28, wherein said interference means facilitates movement together of the pawl with the handle throughout a portion of the arc of rotation of said handle during the operation of the latch assembly.

30. A latch assembly for securing two panels together, said latch assembly comprising:

a) keeper member adapted for mounting on a first panel;

b) closure means adapted for mounting on a second panel, said closure means having actuating means for selectively operating the latch, and pawl means for securing the closure means to the keeper member; wherein the actuating means comprises means for moving the pawl means into and out of engagement with the keeper member for respectively latching and unlatching the latch assembly;

c) wherein said keeper member comprises first means for securing the pawl means thereto and second means for securing the actuating means thereto, said actuating means comprising lock means to selectively lock said pawl means into a latched position; and d) resistance means provided on said keeper member for imparting a resistive force between the keeper member and the closure means when the keeper member and the closure means are brought together for securing.

31. A latch assembly for securing two panels together, said latch assembly comprising:

a) a keeper member adapted for mounting on a first panel;

b) closure means adapted for mounting on a second panel, said closure means having a pawl and a handle having a slot, and including means for rotationally supporting said handle such that said pawl and said handle can rotationally move from an unlatched position to a latched position wherein said handle and said pawl engage said keeper member;

c) wherein said keeper member includes a primary catch for engagement with the pawl, and a secondary catch for engagement with the handle; and d) wherein said secondary catch further includes a gripping portion for facilitating the depression of said secondary catch relative to said handle to release said secondary catch from engagement with said handle slot.

32. A latch assembly for securing two panels together, said latch assembly comprising:

a) a keeper member adapted for mounting on a first panel;

b) closure means adapted for mounting on a second panel, said closure means having a pawl and a handle, and including means for rotating said pawl and said handle from an unlatched position to a latched position wherein said handle and said pawl engage said keeper member;

c) wherein said keeper member includes a primary catch for engagement with the pawl, and a secondary catch for engagement with the handle;

d) wherein the handle includes a slot therein, and wherein said keeper member has hasp means extending therefrom for facilitating locking of the latch assembly with locking means, said handle being movable to engage said keeper member and be secured thereby, with said hasp means extending through said slot;

e) wherein said hasp means includes an aperture therein for receipt of locking means therein;

f) wherein said hasp means has a twisted portion at its end opposite the aperture end, and wherein the secondary catch is provided with a slot therein for accommodating the hasp means, said secondary catch being installed over the hasp means for retention on the keeper member, and g) wherein the keeper member further comprises a retaining member for retaining the secondary catch thereon.

33. A latch assembly for securing two panels together, said latch assembly comprising:

a) a keeper member adapted for mounting on a first panel;

b) closure means adapted for mounting on a second panel, said closure means having a pawl and a handle, and including means for rotating said pawl and said handle from an unlatched position to a latched position wherein said handle and said pawl engage said keeper member;

c) wherein said keeper member includes a primary catch for engagement with the pawl, and a secondary catch for engagement with the handle; and d) wherein said keeper member further includes a hasp means having an aperture end and a twisted portion at its end opposite the aperture end, and wherein the secondary catch is provided with a slot therein for accommodating the hasp means, said secondary catch being installed over the hasp means for retention on the keeper member.

* * * * *